US007663041B1

(12) United States Patent
Lin

(10) Patent No.: US 7,663,041 B1
(45) Date of Patent: Feb. 16, 2010

(54) PEDAL ASSEMBLY FOR PERCUSSION INSTRUMENT

(76) Inventor: Hsi-Tan Lin, No. 43, Longshan 3rd St., Daya Shiang, Taichung County 428 (TW)

( * ) Notice: Subject to any disclaimer, the term of this patent is extended or adjusted under 35 U.S.C. 154(b) by 0 days.

(21) Appl. No.: 12/292,867

(22) Filed: Nov. 28, 2008

(51) Int. Cl.
*G10D 13/02* (2006.01)

(52) U.S. Cl. ..... 84/422.1

(58) Field of Classification Search ..... 84/421, 84/422.1, 422.2, 422.3
See application file for complete search history.

(56) References Cited

U.S. PATENT DOCUMENTS 5,398,584 A * 3/1995 Liao ..... 84/422.1

* cited by examiner

*Primary Examiner*—Kimberly R Lockett
(74) *Attorney, Agent, or Firm*—Rosenberg, Klein & Lee

(57) ABSTRACT

A beater assembly includes a shaft pivotably connected between two supports and a clamping member and a beater are connected to the shaft. A pedal is indirectly connected to the shaft by a chain. A connection member is connected to the shaft and includes a passage in which the clamping member is received. A first bolt extends through the connection member and contacts the clamping member, and a second bolt extends through the connection member and fixes the clamping member to the connection member. The beater and the pedal can be adjusted by loosening the first and second bolts without disengaging the chain from the connection member.

10 Claims, 11 Drawing Sheets

PEDAL ASSEMBLY FOR PERCUSSION INSTRUMENT

FIELD OF THE INVENTION

The present invention relates to a pedal assembly, and more particularly, to an adjustable pedal assembly for percussion instrument.

BACKGROUND OF THE INVENTION

A conventional beater assembly is operated by a pedal and a beater hits the drum by stepping the pedal. The range of swing of the beater relative to the drum and the angle of elevation of the peal is set are different for different users.

FIG. 15 shows a conventional pedal assembly which includes a shaft 91 pivotably connected between two supports 90 and a beater 92 is fixedly connected to the shaft 91. A connection member 93 is connected to the shaft 91 and a chain 94 is connected between the connection member 93 and a pedal which is not shown.

The connection member 93 includes a fixing hole 931 so as to fix one end of the chain 94 to the connection member and the connection member 93 can be rotated about the shaft 91 to adjust the angle of the pedal. The connection member 93 includes an elongate slot 932 and the shaft 91 extends through the elongate slot 932. A sliding member 933 is located between two sidewalls of the connection member 93 and includes a polygonal passage which communicates with the elongate slot 932. The shaft 91 extends through the polygonal passage and a bolt 934 extends through the sliding member 93 and contacts against the shaft 91.

When adjusting the beater 92, the connection member 93 is pivoted about the shaft 91 to adjust the range of swing between the beater 92 and the drum, and the chain 94 has to be disengaged from the connection member 93 and is fixed to the connection member 93 again to set the angle of the pedal. The chain 94 is restricted by the position of the hole 931 of the connection member 93 and the angle of the pedal is also restricted by the position of the hole 931. The chain 94 has to be disengaged from the connection member 93 and fixed to the connection member 93 again. It is inconvenient for the user to adjust the pedal and the beater 92.

It is the point that the present invention intends to improve the shortcoming of the conventional pedal assembly so that the range of swing of the beater 92 and the angle of elevation of the pedal can be precisely and conveniently adjusted.

The present invention intends to provide a pedal assembly which is easily operated and the chain does not need to be disengaged from the connection member when adjusting.

SUMMARY OF THE INVENTION

The present invention relates to a pedal assembly which comprises a shaft pivotably connected between two supports and a clamping member is connected to the shaft. A pedal is indirectly connected to the shaft by a chain and a beater is connected to the shaft. A connection member is located between the shaft and at least one of the pedal and the beater. The connection member includes a passage and the clamping member is received in the passage. A first bolt extends through the connection member and contacts the clamping member, and a second bolt extends through the connection member and fixes the clamping member to the connection member.

The primary object of the present invention is to provide a conveniently and precisely adjustable pedal assembly, wherein the range of swing of the beater and the angle of the pedal can be easily adjusted.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
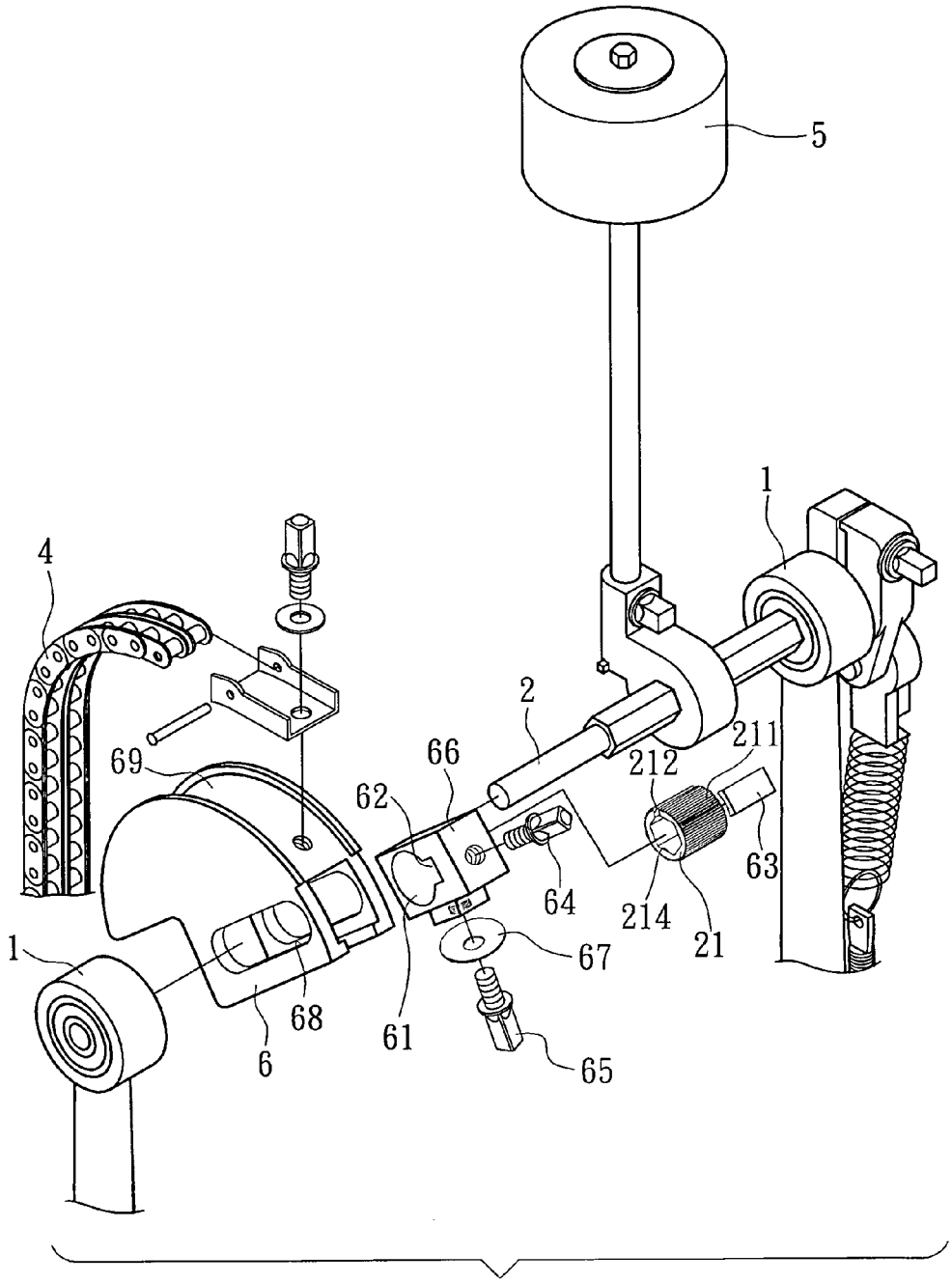
FIG. 1 is an exploded view to show the pedal assembly of the present invention.
Figure 3:
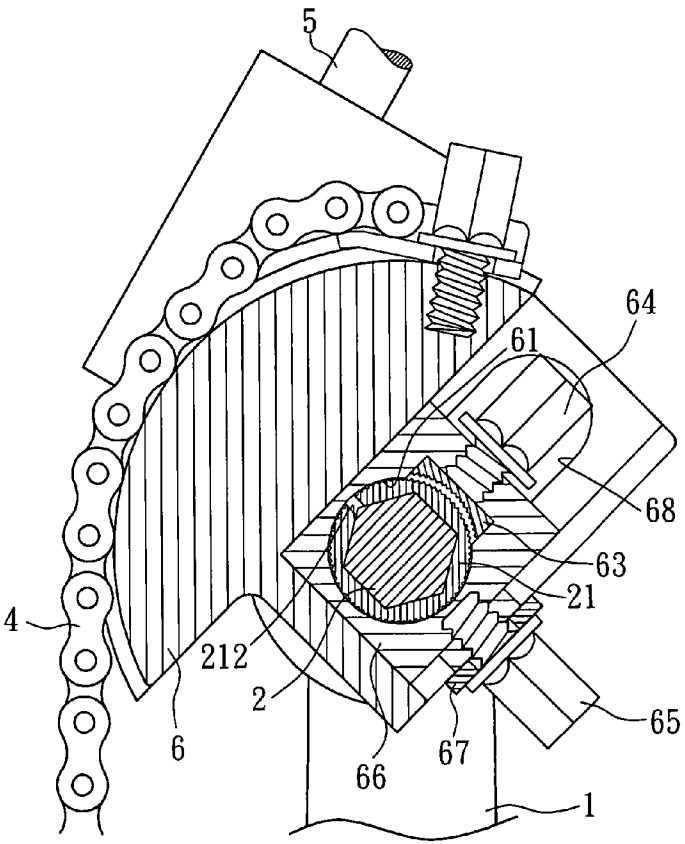
FIG. 3 is a partial cross sectional view wherein the presser is removed from the clamping member by the first bolt and the shaft is independent from the connection member.
Figure 2:
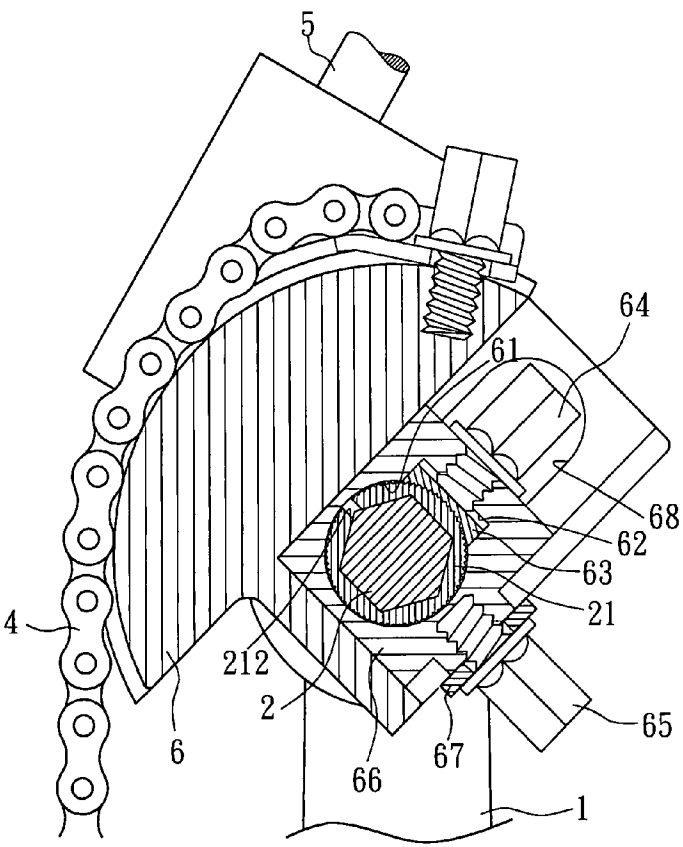
FIG. 2 is a partial cross sectional view wherein the presser presses the clamping member by the first bolt and the shaft is co-rotated with the connection member.

Referring to FIGS. 1 to 7, the beater assembly of the present invention comprises a shaft 2 pivotably connected between two supports 1 and a spring is applied to one end of the shaft 2 to automatically return the shaft 2 after being rotated. A clamping member 21 is connected to the shaft 2 and a beater 5 co-rotatably connected to the shaft 2. A pedal 3 is indirectly connected to the shaft 2 by a chain 4. A connection member 6 is located between the shaft 2 and at least one of the pedal 3 and the beater 5. In this embodiment, the connection member 6 is located between the shaft 2 and the pedal 3. The chain 4 is connected between the pedal 3 and the connection member 6.

The connection member 6 includes a passage 61 and the clamping member 21 is received in the passage 61. A radial slot 62 is defined in an inner periphery of the passage 61 and communicates with the passage 61. A presser 63 is located in the radial slot 62 and a first bolt 64 extends through the connection member 6 and presses the presser 63 onto the clamping member 21. The clamping member 21 and the connection member 6 are securely connected with each other.

In this embodiment, a sliding member 66 is locate din the connection member 6 and includes a passage 61 and the radial slot 62. The clamping member 21 is an individual part and mounted to the shaft 2. The clamping member 21 includes a hexagonal path 214 and the shaft 2 includes a section with hexagonal cross section which is engaged with the hexagonal path 214. A second bolt 65 extends through a washer 67 and is threadedly connected to the sliding member 66 so as to connect the sliding member 66 to the connection member 6. The sliding member 66 and the washer 67 clamp the connection member 6.

The clamping member 21 includes teeth defined in an outer surface 211 thereof and the presser 63 has a toothed surface which faces the teeth of the outer surface 211 of the clamping member 21.

The clamping member 21 includes a gap 212 defined axially through a wall thereof and the gap 212 is narrowed to securely mount the clamping member 21 to the shaft 2 when the first bolt 64 contacts the clamping member 21.

The connection member 6 includes two sidewalls and the sliding member 66 is located between the two sidewalls. Each of the sidewalls includes an elongate slot 68 and the passage 61 of the sliding member 66 is located in communication with the elongate slots 68. The shaft 2 extends through the elongate slots 68 and the passage 61.

In this embodiment, the elongate slots 68 extend the same direction of the direction that the sliding member 66 is movably engaged with the connection member 6 so that the sliding member 66 is moved relative to the connection member 6 when the connection member 6 is adjusted relative to the shaft 2.

The connection member 6 includes a curved recessed area 69 and the chain 4 is engaged with the curved recessed area 69.

When adjusting the range of swing of the beater 5, the second bolt 65 is loosened and the connection member 6 is then able to move along the elongate slots 68 relative to the shaft 2.

Figure 4:
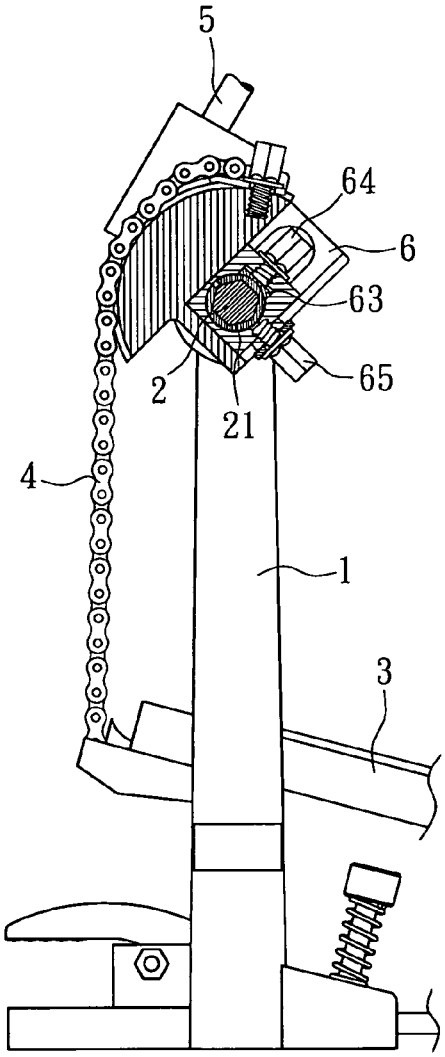
FIG. 4 shows that the connection member is moved upward relative to the shaft.
Figure 5:
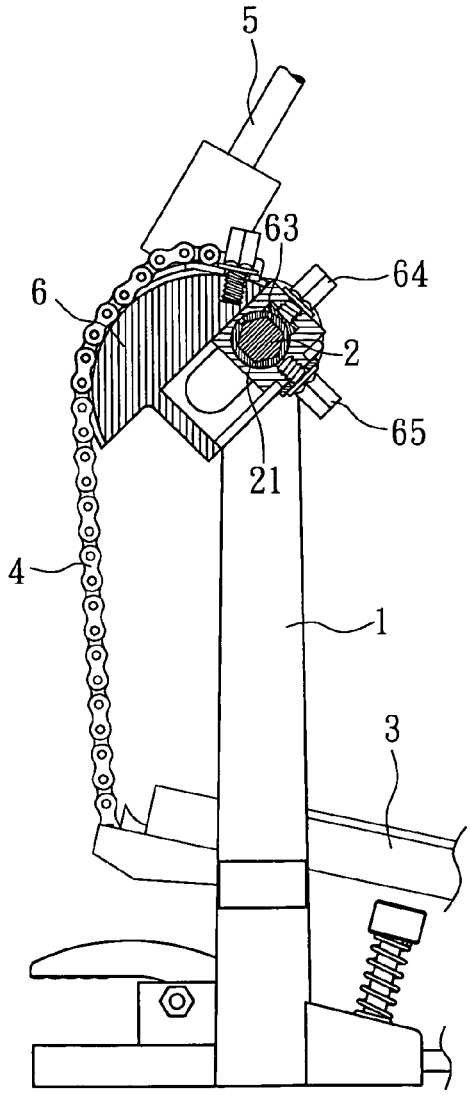
FIG. 5 shows that the connection member is moved downward relative to the shaft.

When the user wants to have a short range of swing between the beater 5 and the drum, the connection member 6 is shifted toward the drum (not shown) as shown in FIG. 5. On the contrary, the connection member 6 is shifted away from the drum (not shown) as shown in FIG. 4 to have a longer range of swing between the beater 5 and the drum.

Besides the adjustment of the range of swing of the beater 3, the adjustment of the angle of elevation of the pedal 3 is another point that the invention intends to provide.

Figure 6:
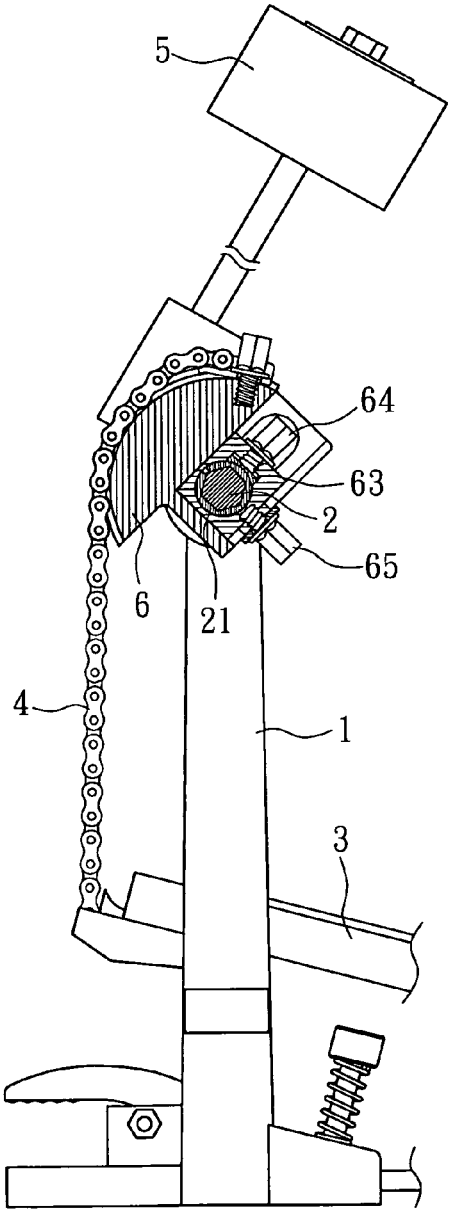
FIG. 6 shows that the connection member is set at the first position and the pedal is located at the corresponding position.
Figure 7:
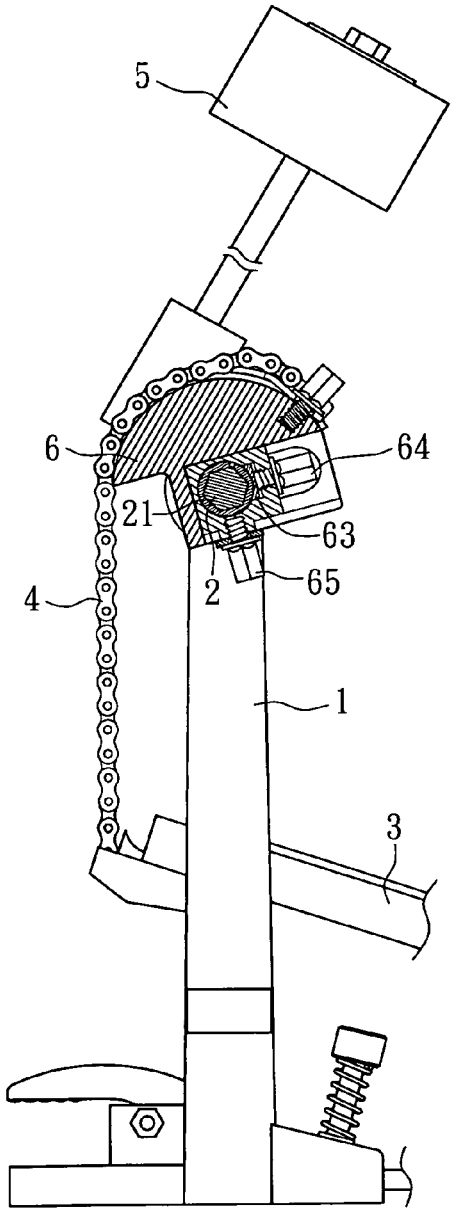
FIG. 7 shows that the connection member is set at the second position and the pedal is located at the corresponding position.

By loosening the first bolt 64, the connection member 6 can be rotated relative to the shaft 2 to move the chain 4 upward or downward. When the chain 4 is lowered as shown in FIG. 6, one end of the peal 3 is lowered and the angle of elevation of the pedal 3 becomes smaller. As shown in FIG. 7, when the chain 4 is moved upward, the end of the peal 3 is lifted and the angle of elevation of the pedal 3 becomes larger than that disclosed in FIG. 6.

Figure 15:
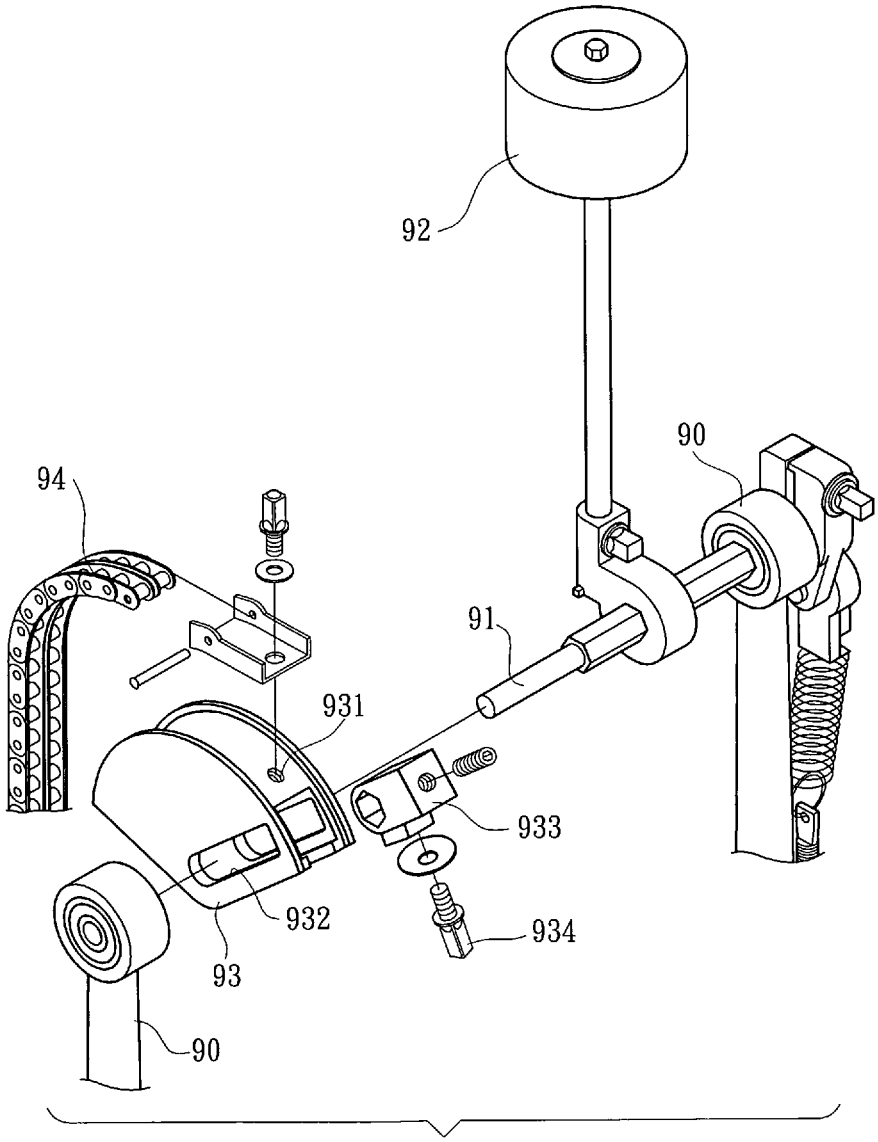
FIG. 15 PRIOR ART
FIG. 15 is an exploded view to show the conventional pedal assembly.

It is noted that the pedal 3 and the beater 5 can be adjusted simultaneously by loosening the first and second bolts 64, 65. By way of horizontal shifting and pivoting, the pedal 3 and the beater 5 can be adjusted in sequence or simultaneously. On the contrary, the pedal 3 of the conventional pedal assembly has to be adjusted one by one. This is much more convenient when compared with the adjustment of the conventional pedal assembly which is restricted by positions of the fixing holes 931 as shown in FIG. 15. The adjustment of the pedal 5 of the present invention is more convenient when adjusting the angle of elevation of the pedal 5 by pivoting the connection member 3, this is because there is no fixing hole in the connection member as the conventional pedal assembly so that the adjustment does not affected by the position of the fixing hole. This fits the requirements of the users to adjust the pedal 3.

Figure 8:
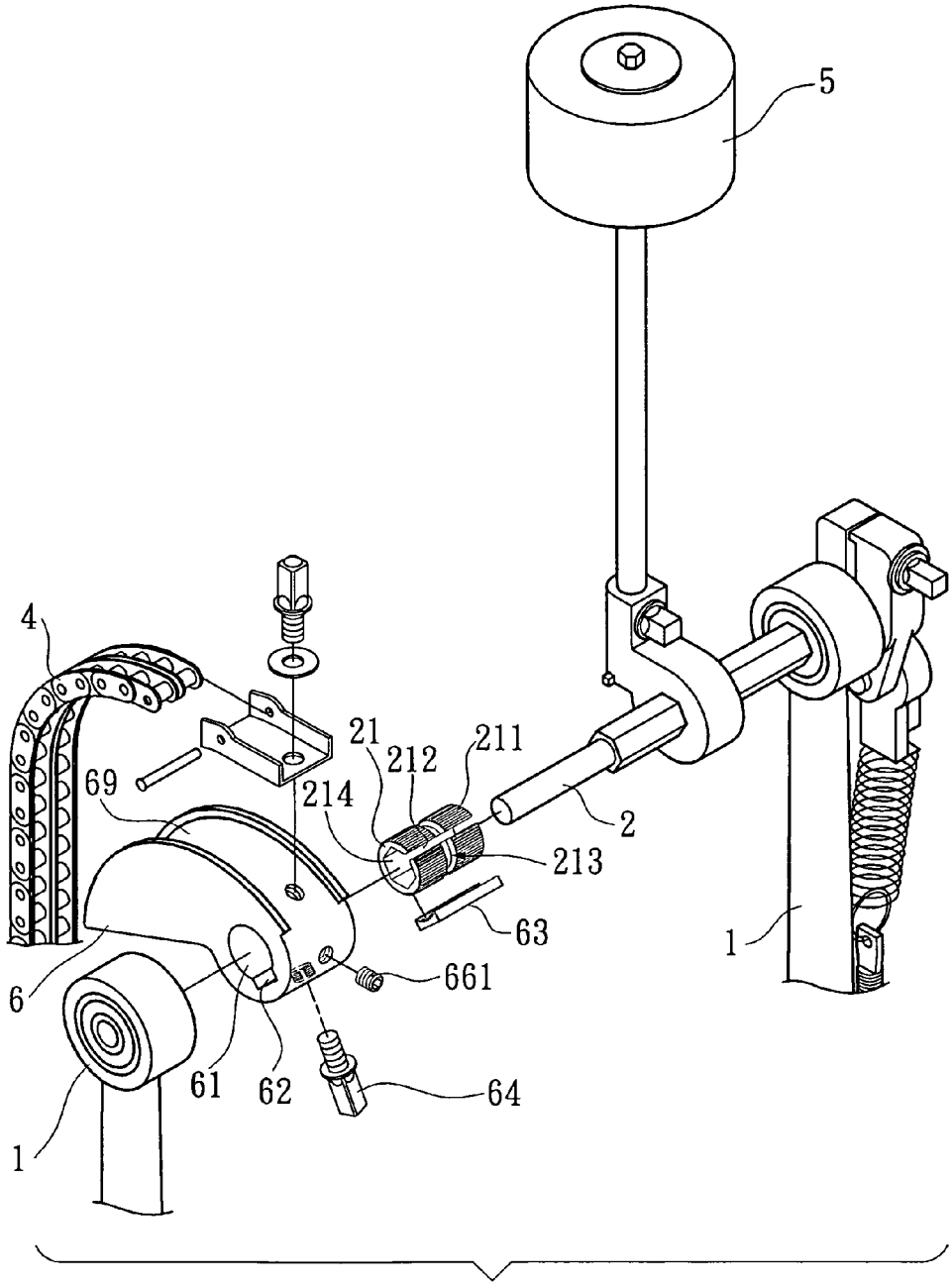
FIG. 8 is an exploded view to show the second embodiment of the pedal assembly of the present invention.

FIG. 8 shows the second embodiment of the pedal assembly of the present invention, wherein the passage 61 is directly formed in the connection member 6 without the sliding member. The simplified design for adjusting the range of swing of the beater 5 can be operated as the first embodiment, wherein the angle of elevation of the pedal 3 can also be adjusted by loosening the first bolt 64 and pivoting the connection member 6 relative to the shaft 2.

The clamping member 21 includes a groove 213 defined radially in an outer surface thereof. A positioning bolt 661 extends through the connection member 6 and is engaged with the sidewall of the groove 213 when the clamping member 21 slides laterally, such that the clamping member 21 is positioned in the passage 61 as show in FIG. 11.

Figure 9:
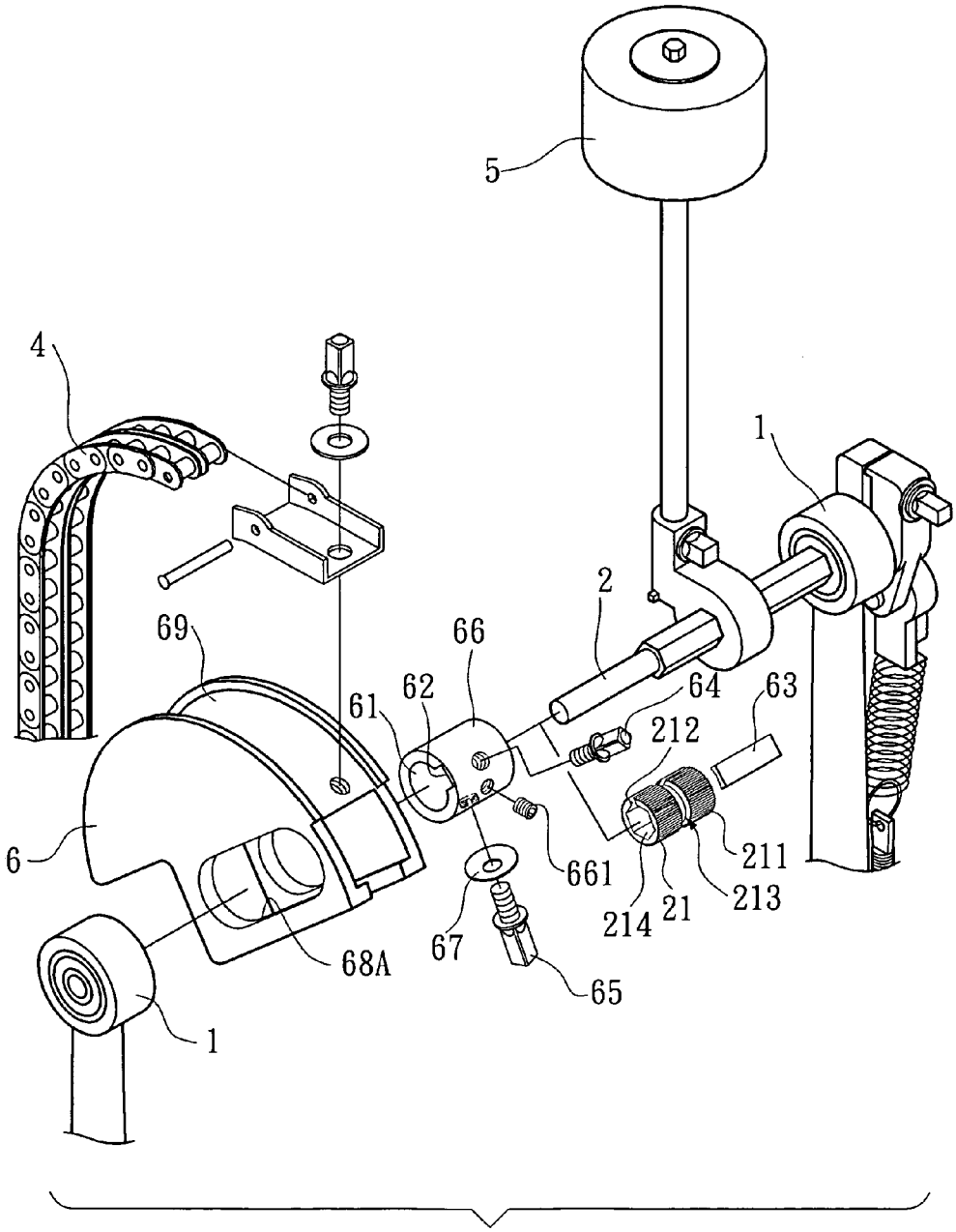
FIG. 9 is an exploded view to show the third embodiment of the pedal assembly of the present invention.
Figure 10:
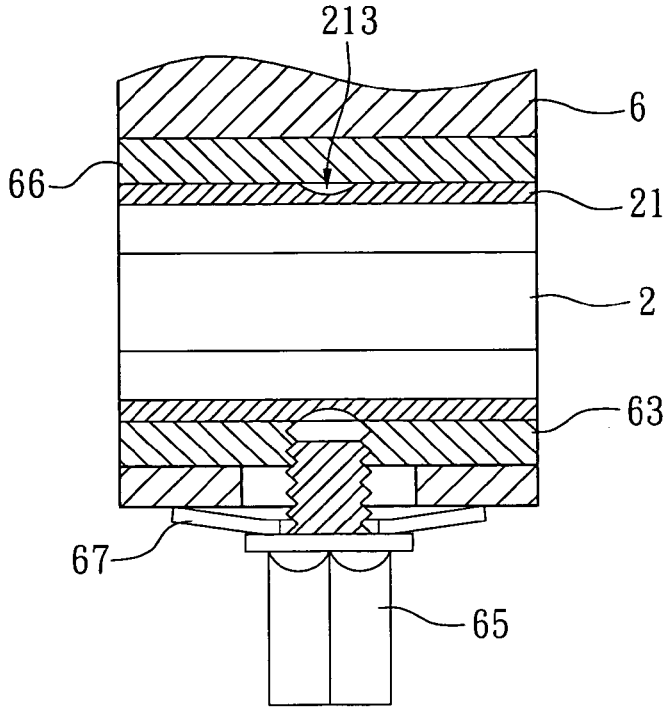
FIG. 10 is a cross sectional view to show the connection of the connection member, the sliding member, the clamping member and the second bolt of the pedal assembly in FIG. 9.
Figure 11:
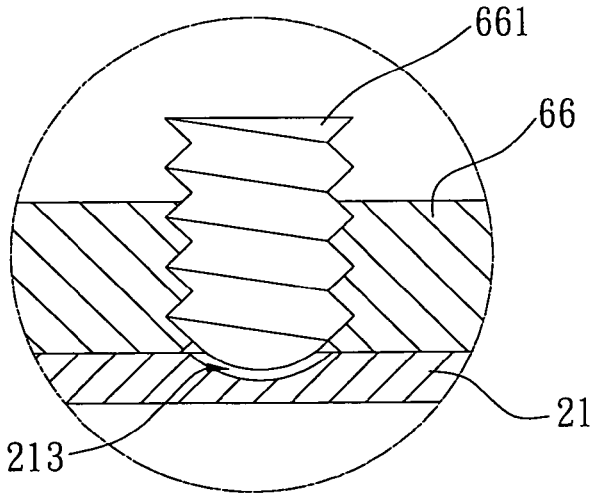
FIG. 11 shows that the positioning bolt is engaged with the groove in the clamping member.

FIGS. 9 and 10 show the third embodiment of the beater assembly of the present invention, wherein the sliding member 66 includes a passage 61 in which the clamping member 21 is located and the radial slot 62 is defined in an inner periphery of the passage 61 and communicates with the passage 61. The sliding member 66 includes a positioning bolt 661 which extends through the sliding member 66 and is engaged with the groove 213 of the clamping member 21 as shown in FIG. 11. The connection member 6 includes two sidewalls and the sliding member 66 is located between the two sidewalls. Each of the sidewalls includes an elongate slot 68A and the sliding member 66 is connected to the connection member 6. The second bolt 65 is threadedly connected to the sliding member 66 so that the sliding member 66 is firmly engaged with the connection member 6. The first bolt 64 is also threadedly connected to the sliding member 66 and presses the presser 63 to the clamping member 21 to fix the connection member 6 to the shaft 2.

The clamping member 21 on the shaft 2 includes a groove 213 defined radially therein and the groove 213 extends in the same direction of the rotation of the clamping member 21. What is different from the second embodiment is that the positioning bolt 661 is located on the lateral side of the sliding member 66 and toward the clamping member 21 which is located within the passage 61.

By the specific arrangement, the angle of elevation of the pedal 3 can be adjusted by the same way as disclosed in the first embodiment. The pedal 3 can also be adjusted by loosening the first bolt 64 and shifting the sliding member 66 along the elongate slots 68A as the purpose that first embodiment achieves.

Figure 12:
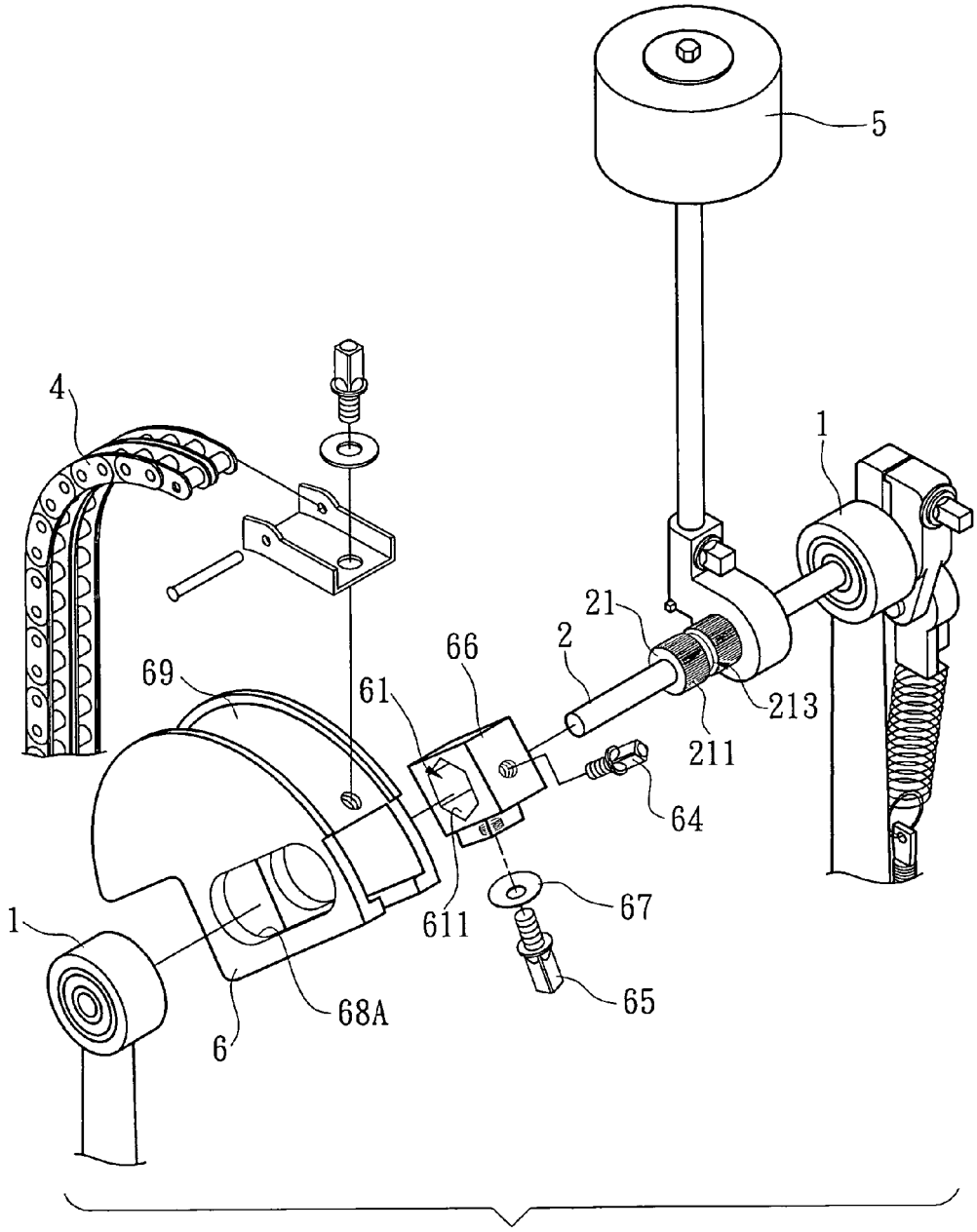
FIG. 12 is an exploded view to show the fourth embodiment of the pedal assembly of the present invention.

FIG. 12 shows the fourth embodiment of the beater assembly of the present invention, wherein the clamping member 21 is integrally formed with the shaft 2 and the first bolt 64 extends through the sliding member 66 and toward the clamping member 21. The passage 61 in the sliding member 66 is a hexagonal passage and the first bolt 64 is engaged with the inner bottom of the groove 213 of the clamping member 21. The clamping member 21 is securely engaged with the insides 611 of the hexagonal passage 61.

Figure 13:
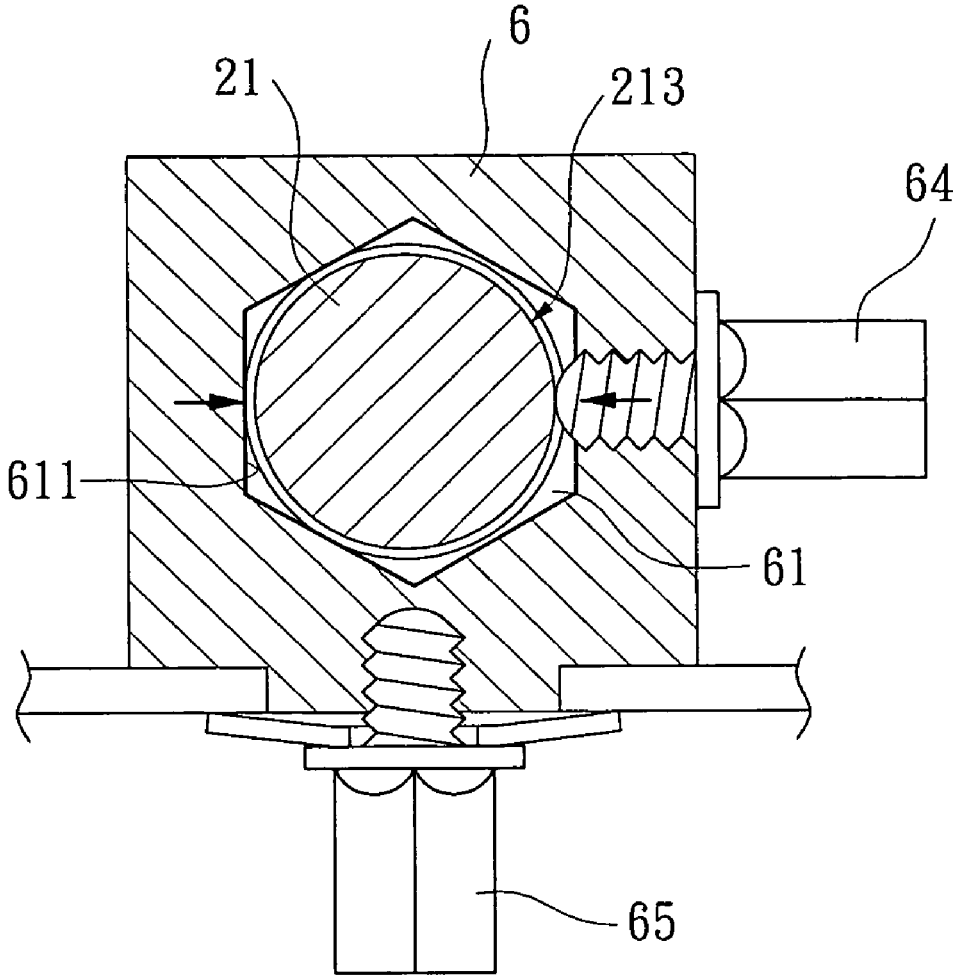
FIG. 13 is a cross sectional view to show the connection of the clamping member on the shaft and the connection member by the first bolt.

In this embodiment, the passage 61 includes a hexagonal inner periphery so that when the clamping member 21 is firmly engaged with the passage 61, the clamping member 21 is positioned by multiple contact points with the insides 611 of the hexagonal passage 61 as shown in FIG. 13.

Figure 14:
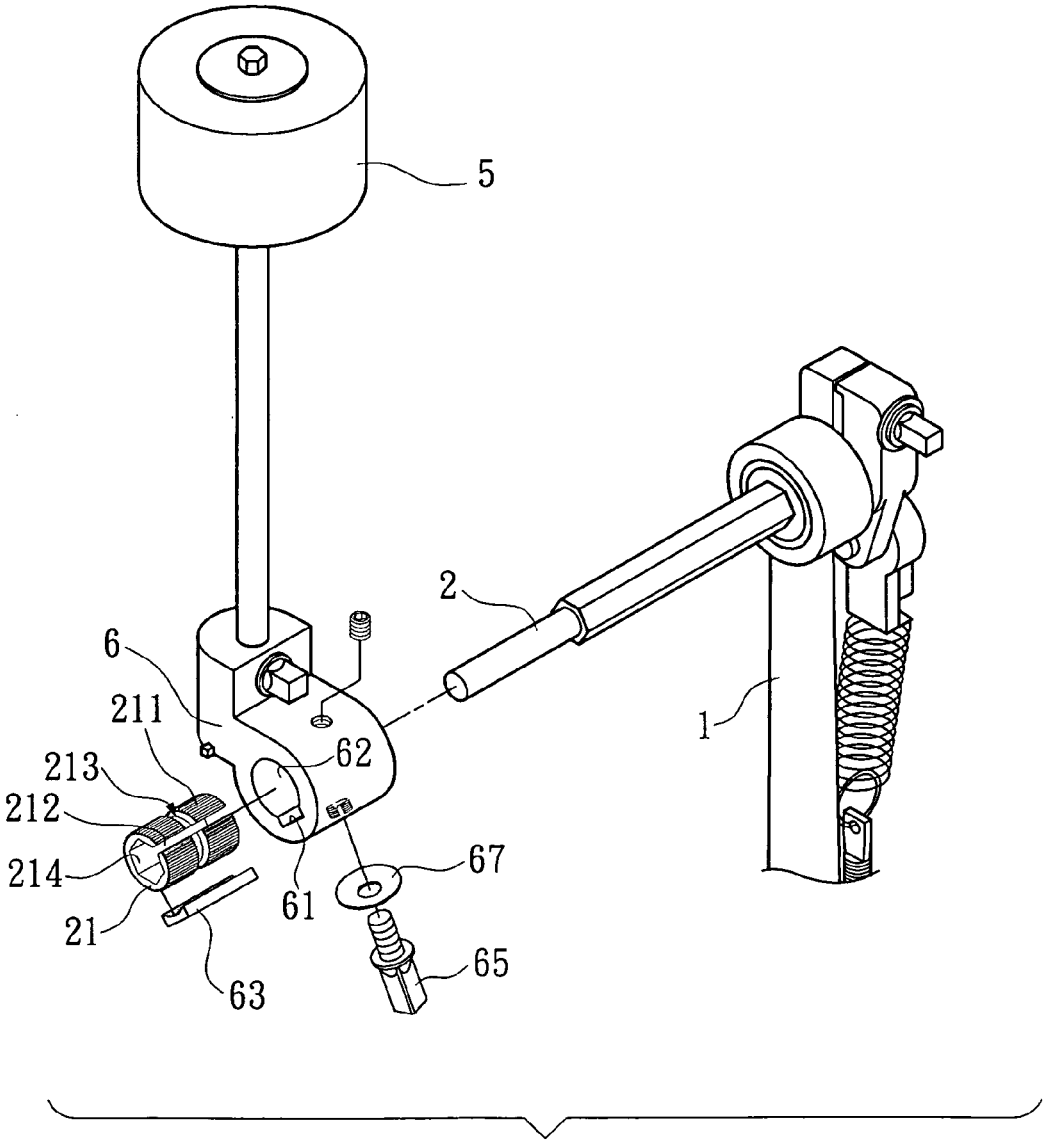
FIG. 14 is an exploded view to show the fifth embodiment of the pedal assembly of the present invention.

FIG. 14 shows the fifth embodiment of the beater assembly of the present invention, wherein the connection member 6 is connected with the beater 5 and the connection member 6 is mounted to the shaft 2 so that the beater 5 can also be adjusted with the connection member 6 relative to the shaft 2.

While we have shown and described the embodiment in accordance with the present invention, it should be clear to those skilled in the art that further embodiments may be made without departing from the scope of the present invention.

What is claimed is:

1. A beater assembly comprising:

a shaft pivotably connected between two supports and a clamping member connected to the shaft, a pedal indirectly connected to the shaft by a chain and a beater connected to the shaft, a connection member located between the shaft and at least one of the pedal and the beater, the connection member having a passage and the clamping member received in the passage, a first bolt extending through the connection member and contacting the clamping member so that the clamping member is connected to the connection member, a sliding member being located in the connection member and includes a passage in which the clamping member is located, a radial slot being defined in an inner periphery of the passage and communicating with the passage, a presser being located in the radial slot and the first bolt pressing the presser onto the clamping member, a second bolt extending through a washer and being threadedly connected to the sliding member, the sliding member and the washer clamping the connection member.

2. The beater assembly as claimed in claim 1, wherein the clamping member includes a groove defined radially in an outer surface thereof, a positioning bolt extends through the sliding member and is engaged with the groove such that the clamping member is positioned in the passage.

3. The beater assembly as claimed in claim 1, wherein the clamping member includes teeth defined in an outer surface thereof and the presser has a toothed surface which faces the teeth of the outer surface of the clamping member.

4. The beater assembly as claimed in claim 1, wherein the clamping member includes a gap defined axially through a wall thereof and the gap is narrowed when the first bolt contacts the clamping member.

5. The beater assembly as claimed in claim 1, wherein the connection member includes two sidewalls and the sliding member is located between the two sidewalls, each of the sidewalls includes an elongate slot and the passage of the sliding member is located in communication with the elongate slots, the shaft extends through the elongate slots and the passage.

6. A beater assembly comprising:

a shaft pivotably connected between two supports and a clamping member connected to the shaft, a pedal indirectly connected to the shaft by a chain and a beater connected to the shaft, a connection member located between the shaft and at least one of the pedal and the beater, the connection member having a passage and the clamping member received in the passage, a first bolt extending through the connection member and contacting the clamping member so that the clamping member is connected to the connection member, a sliding member being located in the connection member and including a passage in which the clamping member is located, the first bolt pressing the clamping member to contact against the connection member, the second bolt extending through a washer and being threadedly connected to the sliding member.

7. The beater assembly as claimed in claim 6, wherein the connection member includes two sidewalls and the sliding member is located between the two sidewalls, each of the sidewalls includes an elongate slot and the sliding member is located corresponding to the elongate slots, the clamping member on the shaft includes a groove defined radially in an outer surface thereof, the first bolt extends through the sliding member and is engaged with the groove such that the clamping member securely contacts against an inside of the passage.

8. The beater assembly as claimed in claim 7, wherein the passage is a hexagonal passage.

9. The beater assembly as claimed in claim 1, wherein the clamping member is an individual part and mounted to the shaft and the clamping member includes a hexagonal path and the shaft includes a section with hexagonal cross section which is engaged with the hexagonal path.

10. The beater assembly as claimed in claim 1, wherein the clamping member is integrally formed with the shaft.

* * * * *